US005313175A

United States Patent [19]

Bahl et al.

[11] Patent Number: 5,313,175

[45] Date of Patent: May 17, 1994

[54] BROADBAND TIGHT COUPLED MICROSTRIP LINE STRUCTURES

[75] Inventors: Inder J. Bahl, Roanoke; David A. Willems, Salem, both of Va.

[73] Assignee: ITT Corporation, New York, N.Y.

[21] Appl. No.: 2,622

[22] Filed: Jan. 11, 1993

[51] Int. Cl.[5] ..... H01P 5/18

[52] U.S. Cl. ..... 333/116; 333/238

[58] Field of Search ..... 333/116, 238

[56] References Cited

U.S. PATENT DOCUMENTS

| | | | |
|---|---|---|---|
| 3,500,255 | 3/1970 | Ho et al. | 333/116 |
| 3,560,891 | 2/1971 | MacLeay et al. | 333/116 X |
| 3,644,850 | 2/1972 | Ho | 333/238 X |
| 5,008,639 | 4/1991 | Pavio | 333/116 |

*Primary Examiner*—Paul Gensler

*Attorney, Agent, or Firm*—Patrick M. Hogan; Arthur L. Plevy

[57] ABSTRACT

A coupled line structure for microwave signals employs a gallium-arsenide substrate having an embedded metallic line located on a surface of the substrate. The surface of the substrate is covered with a thin dielectric layer and at least another metallic line is positioned on the dielectric layer and parallel to the embedded line with a portion of the lines overlapping one another for coupling. A third line can also be disposed on the dielectric layer which line is parallel to the other lines and where the embedded line is connected by a via hole to one of the lines on the dielectric.

13 Claims, 6 Drawing Sheets

BROADBAND TIGHT COUPLED MICROSTRIP LINE STRUCTURES

FIELD OF THE INVENTION

This invention relates to coupled microstrip line structures in general, and more particularly to a microwave quadrature coupler apparatus using embedded microstrip lines.

BACKGROUND OF THE INVENTION

Quadrature couplers are indispensable microwave components. They are used in phase shifters, balanced amplifiers, mixers, baluns and other microwave circuits. Basically, a coupler splits equally or unequally, microwave or RF signals into two output signals having a 90 degree phase difference. Many of these applications require 3 dB couplers which are traditionally realized using tightly coupled interdigitated multi-conductor microstrip lines, such as the Lange coupler. See an article entitled "INTERDIGITATED STRIP LINE QUADRATURE HYBRID", published in the IEEE Transactions On Microwave Theory Tech. Vol. MTT-17 December 1969, pages 1150–1151 by J. Lange. The coupler described in that article is referred to as the Lange coupler. See also an article entitled "GaAs MONOLITHIC LANGE AND WILKINSON COUPLERS", by R. C. Waterman, Jr. et al., published in IEEE Transactions Electron Devices, Vol. ED-28, pages 212–216, February 1981. In these structures, the conductor widths and the spacings between the coupler's conductors can be produced with standard thin film manufacturing processes on thick low-dielectric constant substrates (>250 μm, $\epsilon_r<10$). However, on thin GaAs substrates used for monolithic microwave integrated circuits or MMICs (75–125 μm, $\epsilon_r=12.9$), tightly coupled structures are difficult to realize. For example, a process with a minimum line width of 8 μm and a minimum spacing of 8 μm cannot be used to fabricate a 3 dB Lange coupler on a 75 μm thick substrate because dimensions of approximately 4 μm are required. Other techniques such as broadside coupled lines and semi-reenterant sections have been proposed as alternative techniques to achieve tight coupling with reasonable manufacturing tolerances. See for example an article by J. S. Izadian entitled "A NEW 6–18 GHz, −3 dB MULTISECTION HYBRID COUPLER USING ASYMMETRIC BROADSIDE, and EDGE COUPLED LINES", published in the 1989 IEEE MTT-S Digest, pages 243–247. See also an article entitled "A QUASI-TEM DESIGN METHOD FOR 3 dB HYBRID COUPLERS USING A SEMI-REENTRANT COUPLING SECTION", published in the IEEE Transactions on Microwave Theory Tech., Vol. MTT-38, No. 11, November 1990, pages 1731–1736.

These coupled line structures require an extra dielectric layer, usually polyimide, whose thickness must be adjusted to control the coupling factor and does not allow other structures on the same substrate to use different coupling factors. Couplers using microstrip are of great interest because they are compatible with microwave integrated circuits (MICs) and monolithic microwave integrated circuits (MMICs). As indicated, 3 dB broadband couplers are extremely difficult to fabricate using microstrip on thin substrates because of the tight mechanical dimensions. This is especially true on thin GaAs substrates (3 mil thick) for power applications. Such couplers are exceptionally difficult to fabricate and many designers have been looking for other alternatives. As indicated above, the most common technique which mitigates the tight tolerances is the use of interdigitated structures.

It is an object of the present invention to provide a coupled line structure that employs embedded microstrip lines to achieve extremely tight couplings on thin substrates as, for example, on gallium-arsenide substrates. Additionally, the coupled line structure allows each component on the same integrated circuit to use different coupling factors.

SUMMARY OF THE INVENTION

A microwave coupled line apparatus for providing tight coupling at microwave frequencies comprises a substrate formed of a semiconductor material and having a top and a bottom surface, a first embedded metal line located on a top surface of said substrate, a dielectric layer covering said metal line and said top surface of said substrate, a second metal line positioned on said dielectric layer and overlying a portion of said first metal line to enable coupling of a microwave signal applied to said second line to propagate in said first embedded line.

DETAILED DESCRIPTION OF THE FIGURES

Figure 1:
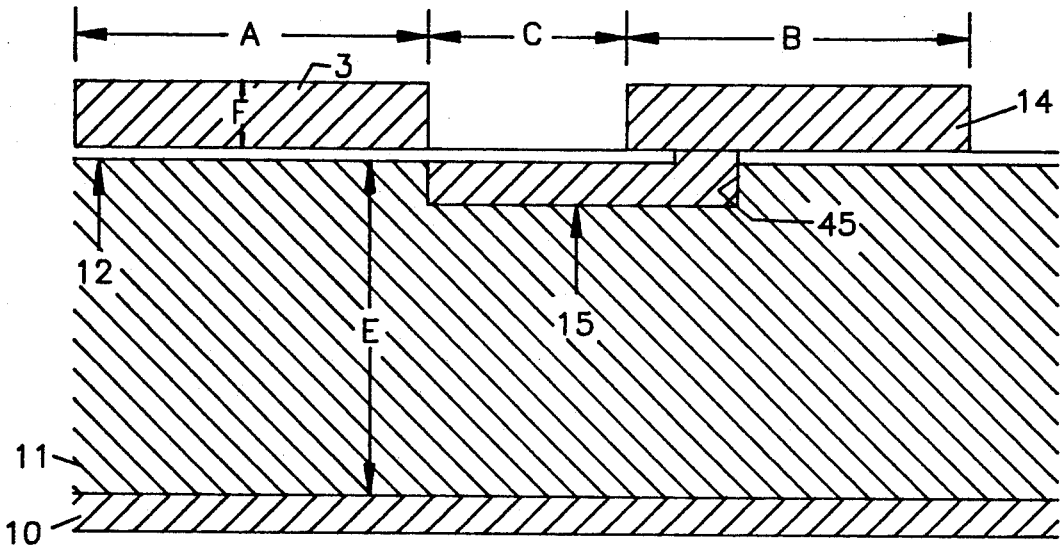
FIG. 1 is a cross-sectional view of a coupled line structure according to this invention.

Before proceeding with the description of the invention, it is indicated that it is known that the coupling factor of multi-conductor couplers can be increased by decreasing the spacing between the couplers conductors. Typically, MMIC metallization processes use a plate up technique that can achieve low loss and uniform spacings. The conductors, which are plated 4 to 5 μm thick, must have spacings between the conductors greater than 8 μm to achieve high yields. Unfortunately, dimensions of half this size are required for the realization of a 3 dB coupler on a 75 μm thick GaAs substrate. The limitations of the above described apparatus are due to the limitations of the photolithographic and plating processes. Referring to FIG. 1, there is shown a cross-sectional representation of a coupled line structure that provides a coupling factor of 2 dB and can be used to make couplers having bandwidths of several octaves.

As seen in FIG. 1, there is shown a ground plane 10. Disposed upon the ground plane 10 is a substrate 11 which is typically fabricated from gallium-arsenide (GaAs) and for present purposes has a thickness as the dimension E of 125 μm. The fabrication of gallium-arsenide substrates on metallic ground planes 10 is well known. The substrate has deposited on a top surface thereof a very thin layer dielectric 12. The dielectric layer may conventionally be silicon nitride and is approximately 0.2 μm thick ($Si_xN_y$) as for example $Si_3N_4$. While silicon nitride is described, it is understood that silicon dioxide or other insulative layers could be utilized, as well as $Ta_2O_5$, $Al_2O_3$ and so on. Disposed on the top surface of the layer 12 of silicon nitride is a first conductive line 13 of a given thickness F of about 4.5 μm with a effective width A of 30 μm. The conductive line 13 is an extended line and is fabricated from a metal conductor such as Cr, Au or other known metals used in GaAs processing techniques. The conductor or line 13 is simply a plated microstrip line. Essentially, conductor 13 consists of a plated metal. Separated from conductor 13 is another conductive line 14 of a width B which is approximately 20 μm. The conductor 13 is separated from plated conductor 14 by a distance C of about 10 μm. Positioned beneath the dielectric layer 12 and embedded in the substrate 11, is a thin conductive unplated metallic layer 15 which is connected through a via hole 45 in the dielectric layer 12 to the 20 μm wide plated microstrip line 14. The thickness of the layer 15 is approximately 0.6 μm. The separation of 10 μm (C) between the plated line 13 and the plated line 14 is dictated by limits of the photolithographic process in order to achieve 4.5 μm thick plated conductors. The plated line 14 connected to the embedded microstrip transmission line 15 reduces the coupler's insertion loss.

Fabrication techniques for the structure shown in FIG. 1 are well known. Typically, the semi-insulating semi-conductor substrate 11 of gallium-arsenide (GaAs) has deposited on the top surface the extremely thin layer of metal 15. The metal layer 15 is not plated. Next, a thin layer of an insulating dielectric such as $Si_xN_y$ ($Si_3N_4$) or something similar is placed over the metal layer as shown in FIG. 1. The thin layer 12 thus covers the metal layer. Since the dielectric covers the microstrip transmission line 15, the term embedded microstrip is used. In this manner, the line 15 can actually be embedded in a channel etched on the surface of the GaAs substrate. On top of the dielectric layer 12, a top layer of metal is deposited and plated to produce both conductors 13 and 14. Because the embedded microstrip requires a thin metallization to be compatible with the MMIC manufacturing process, the insertion loss caused by resistive losses can be quite high. However, via hole technology is employed to form the hole 45 in the dielectric layer 12 to allow the top metal conductor 14 to connect to the embedded microstrip conductor 15. The stripline 15 overlaps line 14 partially in order to reduce the overall insertion loss of the coupler. Because the first metal conductor 13 is insulated by a dielectric, it is positioned as close as desired to the top parallel metal conductor line 14. The top level metal line 14 connected to the embedded microstrip conductor 15 can be as close to the top level metal conductor 13 as plating and other manufacturing tolerances allow and typically 8 to 10 μm apart.

Based on the structure shown in FIG. 1 and based on the above described dimensions, the coupled line structure can be employed to fabricate a 6 to 21 GHz coupler on a 125 μm GaAs substrate. Essentially, the fabrication of the structure shown in FIG. 1 is well within the ability of those skilled in the art. A microstrip is normally employed in circuits where discrete devices are bonded to the circuit, where easy access is needed for tuning and where a compact design is needed. Since the electromagnetic fields lie partly in air and partly in the dielectric, obtaining solutions for the characteristic impedance and effective dielectric constant is more complicated than it is for stripline. Microstrip is only approximately a TEM transmission line, but unless the circuit is used for very broadband width applications or it is physically many wavelengths long, dispersion will not be a problem. The fabrication of microstrip structures, in conjunction with gallium-arsenide integrated circuit technology, is well known. See a text entitled "GaAs INTEGRATED CIRCUITS-DESIGN and TECHNOLOGY", edited by Joseph Mun and published by MacMillan Publishing Company of New York (1988). This text describes various techniques for fabricating gallium-arsenide structures including microstrips structures as well.

As one can ascertain for MMICs employing the microstrip configuration, the substrate thickness determines circuit losses (element Q), the microstrip line width and the upper frequency limit due to the higher order modes. The cut-off frequency for the lowest order (TE) surface mode as a function of substrate thickness is well known. In any event, microstrip conductor losses are inversely proportional to the substrate thickness as is also well known. The use of via holes normally limits the substrate thickness employing present via hole technology, the hole is normally etched through the substrate from the backside as described in many references.

Figure 2:
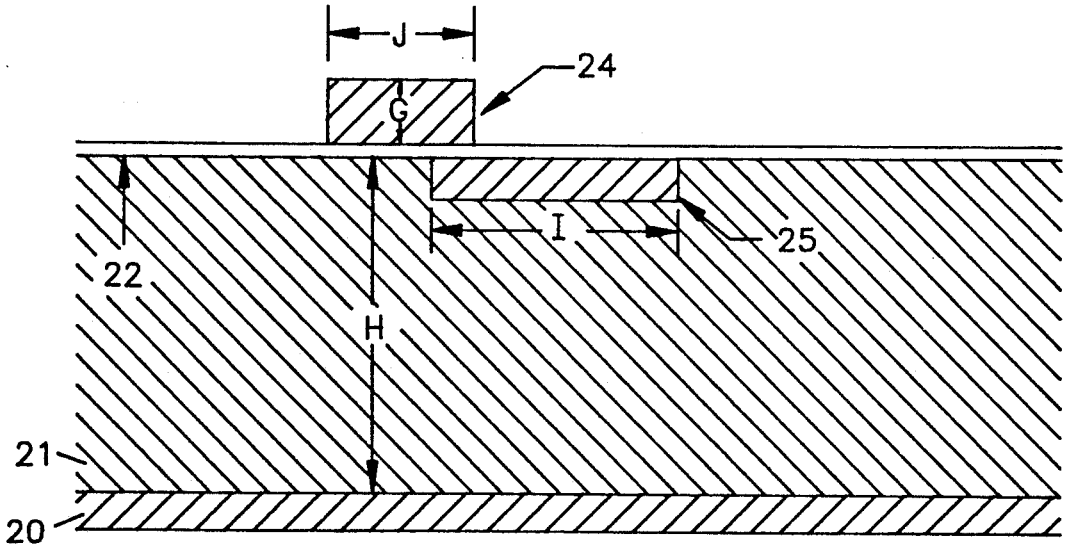
FIG. 2 is a cross-sectional view of a coupled line structure according to an alternative embodiment of the invention.

Referring to FIG. 2, there is shown a cross-sectional representation of a very tightly coupled line structure used to realize a 90 degree Schiffman section. The Schiffman section employs a 90 degree coupled line shorted at one end and is typically used in phase shifters. It provides 90 degrees of insertion phase with respect to 90 degree length of transmission line over a wide bandwidth. The bandwidth can be greater than an octave if an extremely tight coupling factor of approximately 0.7 dB is used. To achieve the desired coupling factors, the conductors must be overlapped forming an offset broadside coupler.

As seen in FIG. 2, there is shown a ground plane 20 upon which a gallium-arsenide substrate 21 is deposited. The gallium-arsenide substrate 21 has an effective thickness of 125 μm (H). Disposed upon the surface of the gallium-arsenide substrate is a very thin layer of unplated metal 25 which forms a line configuration. Then deposited on top of the surface of the thin metal layer 25 is a layer 22 of a dielectric, such as silicon nitride ($Si_xN_y$) which again is typically 0.2 μm thick. Deposited on top of the layer of silicon nitride and overlapping the metal line 25 is a plated metal line 24. The line 24 has an effective thickness G of 4.5 μm with a width J of 10 μm. In any event, the structure shown in FIG. 2 is used to fabricate an octave bandwidth Schiffman section on a 125 μm GaAs substrate. As indicated above, to achieve the desired coupling factor, the conductors 25 and 24 must be overlapped forming an offside broadside coupler. The conductors in the case of FIG. 2 overlap by 2

μm and are 10 μm wide. The conductor 25 which is buried in the dielectric is too narrow to add any plating. The analysis of these coupled line geometries is relatively difficult. The lines are asymmetrically edge coupled in the coupler, as shown in FIG. 1. The lines are offset asymmetrically broadside coupled in the Schiffman section, as shown in FIG. 2. The design parameters for the structures of FIG. 1 and FIG. 2 are summarized in TABLE 1.

TABLE 1

The physical dimensions of the 3 dB coupler and the 90 degree Schiffman section.

| Parameter | 6 to 21 GHz Coupler | 5 to 15 GHz 90° Schiffman Section | Unit |
|---|---|---|---|
| Conductor width | 30 | 10 | μm |
| Conductor length | 1900 | 5250 | μm |
| Conductor overlap | 0 | 2 | μm |
| Plating thickness | 4.5 | 4.5 | μm |
| Dielectric layer's | 0.2 | 0.2 | μm |
| Dielectric constant of dielectric layer | 6.7 | 6.7 | |
| Unplated metal thickness | 0.6 | 0.6 | μm |
| Substrate thickness | 125 | 125 | μm |
| Dielectric constant of substrate | 12.9 | 12.9 | |

Figure 3:
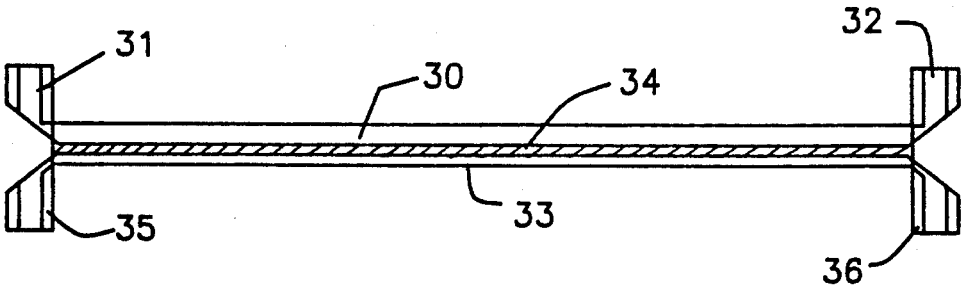
FIG. 3 is a top plan view of a multi-octave bandwidth coupler according to this invention.

Referring to FIG. 3, there is shown a top plan view of a multi-octave bandwidth coupler using edge coupling and employing embedded microstrip techniques according to that shown in FIG. 1. Essentially, as seen in FIG. 3, there is shown a top conductive line 30 which is analogous to line 13 of FIG. 1. Adjacent to top conductive line 30 is another conductive line 33 which is equivalent to line 14 of FIG. 1. The embedded line which is 15 of FIG. 1 is depicted by reference numeral 34. In any event, there are input/output ports 31 and 35 associated with the conductive lines 30 and 33, as well as isolated port/outputs 36 and 32. In this manner, one forms a quadrature coupler which splits input microwave or RF signals into two output signals at terminals 32 and 35 which signals have a 90 degree phase shift with respect to one another.

Figure 4:
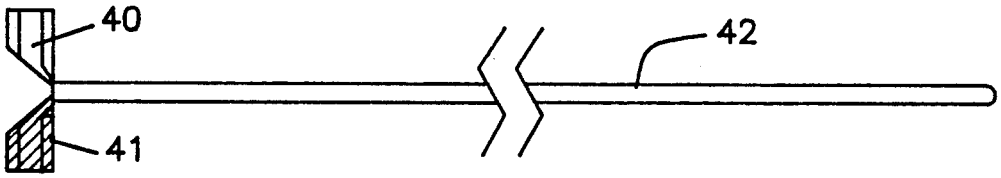
FIG. 4 is a top view of a Schiffman section utilizing an asymmetric broadsided coupled line structure according to this invention.

Referring to FIG. 4, there is shown a top view of a Schiffman section employing an asymmetric broadsided coupler line structure which is similar to the structure shown in FIG. 2. Essentially, terminal 40 is an input terminal with terminal 41 being an output terminal. The conductor or line structure designated by reference numeral 42 comprises the top line structure as 24 of FIG. 2 which overlaps the buried or embedded line structure 25 as explained. It is noted that the fabrication of both the structures shown in FIG. 3 and FIG. 4 do not require any extra processing steps as they are fabricated with the same process steps as employed in metal-insulator-metal (MIM) capacitors.

Figure 5:
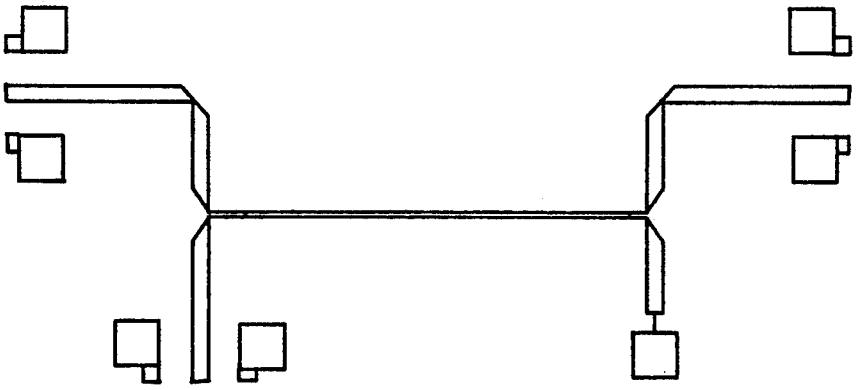
FIG. 5 is a depiction of a microphotograph of a coupler in accordance with this invention.

FIG. 5 shows a top view of a microphotograph of a 6 to 21 GHz 3dB coupler in a TRL test structure. As indicated, the structure is fabricated utilizing typical gallium-arsenide fabrication techniques. The 3 dB coupler is fabricated on a 125 μm GaAs substrate using the coupled line structure shown in FIG. 1. FIG. 5 shows the microphotograph of the completed structured. The construction starts with the deposition of a thin (about 0.6 μm) strip 15 (FIG. 1) of metal unto the GaAs substrate 11. This process step forms the bottom plates of capacitors and the lower conductors in air bridge cross over on MMICs. Next a dielectric layer of silicon nitride 12 ($Si_xN_y$) is deposited covering the entire surface of the MMIC. The dielectric layer 12 also serves as the insulator in the MIM capacitors. The fabrication of MIM capacitors is well known. See the above text entitled "GaAs INTEGRATED CIRCUITS" Chapter 4 entitled "MONOLITHIC MICROWAVE INTEGRATED CIRCUIT-DESIGN" by J. M. Schellenberg, et al., describes MIM capacitors on page 219. Also see section 5-3-2 entitled "CAPACITORS" on page 301 of that text. Then a via hole, as hole 45 of FIG. 1 is etched in the dielectric layer 12 which enables the connection of the conductor 14 to conductor 15 on each side of the dielectric. The coupler is completed by adding the plated microstrip lines, such as 13 and 14 which are formed on the MMIC at the same time as the rest of the microstrip lines, inductors and capacitor top plates, as for example shown in FIGS. 3, 4 and 5. The Schiffman section shown in FIG. 4 is fabricated in a like manner on a 125 μm GaAs substrate using the structure shown in cross-section in FIG. 2.

Figure 6:
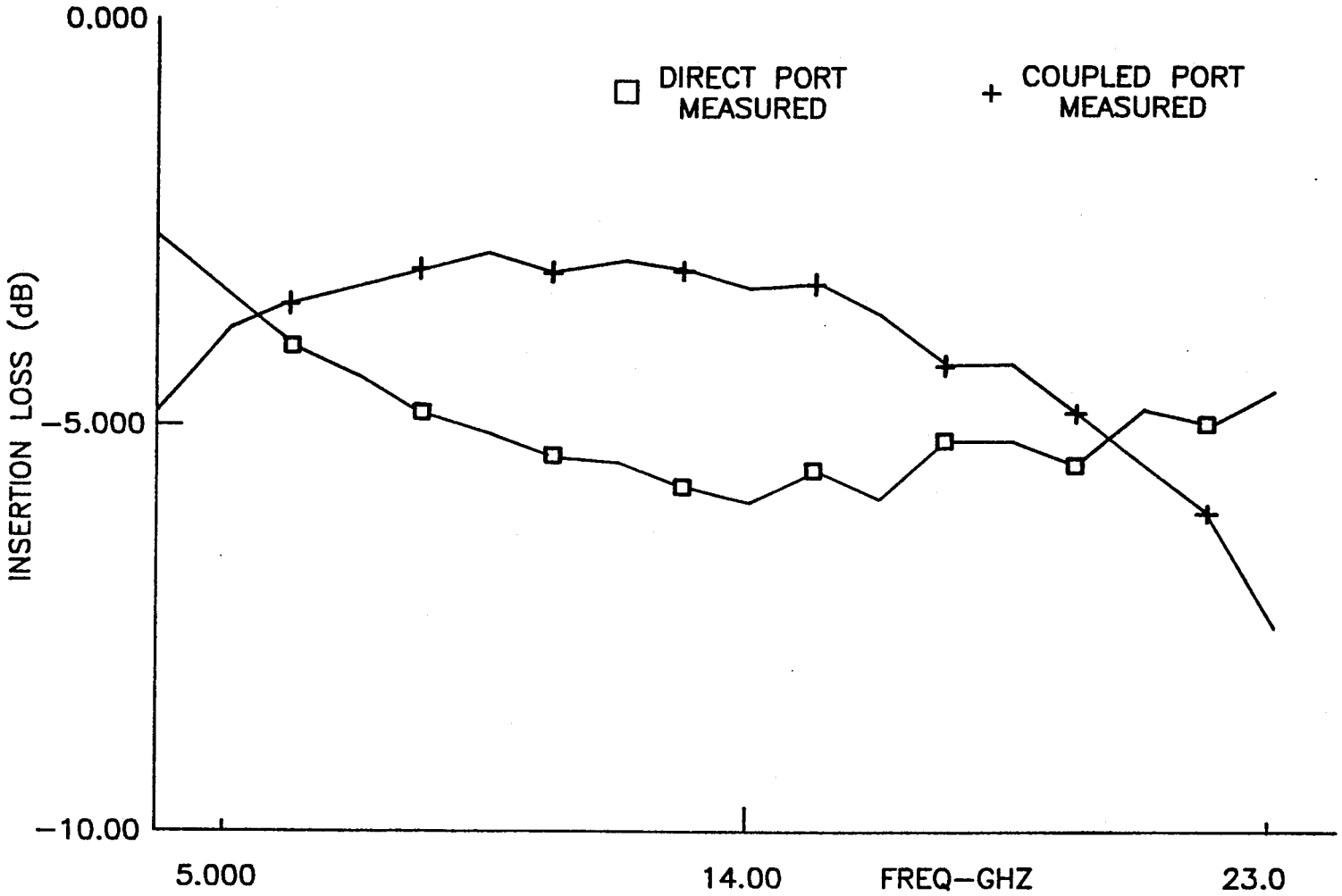
FIG. 6 is a graph depicting an embedded microstrip coupler's transmission response according to this invention.

The couplers were tested on-wafer using TRL deembedding techniques. FIG. 6 shows the typical measured performance of the broadband coupler which achieved a 16 GHz bandwidth with a ±1 dB amplitude variation. The coupler had a return loss at all ports of greater than 15 dB and the isolation was greater than 10 dB. The phase difference between the output ports of 90±5 degrees over the 5 to 21 GHz band was also excellent. A second coupler was constructed with the same structure having a length of 5700 μm and demonstrated similar performance over the 2 to 7 GHz band.

Figure 7:
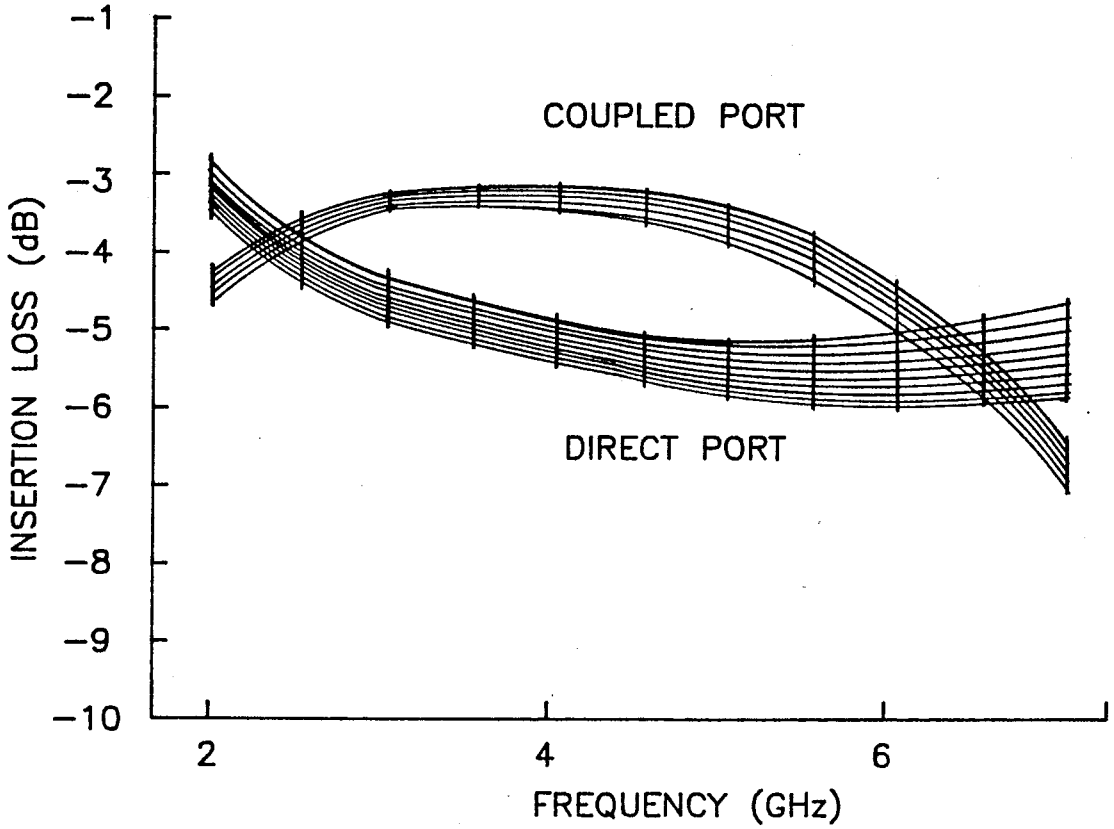
FIG. 7 is a graph depicting a scatter plot of thirty embedded microstrip couplers.

FIG. 7 shows the plot of several dozen (30) of these couplers demonstrating the manufacturability of the tightly coupled structure. The Schiffman section was also tested on-wafer using TRL deembedding techniques.

Figure 8:
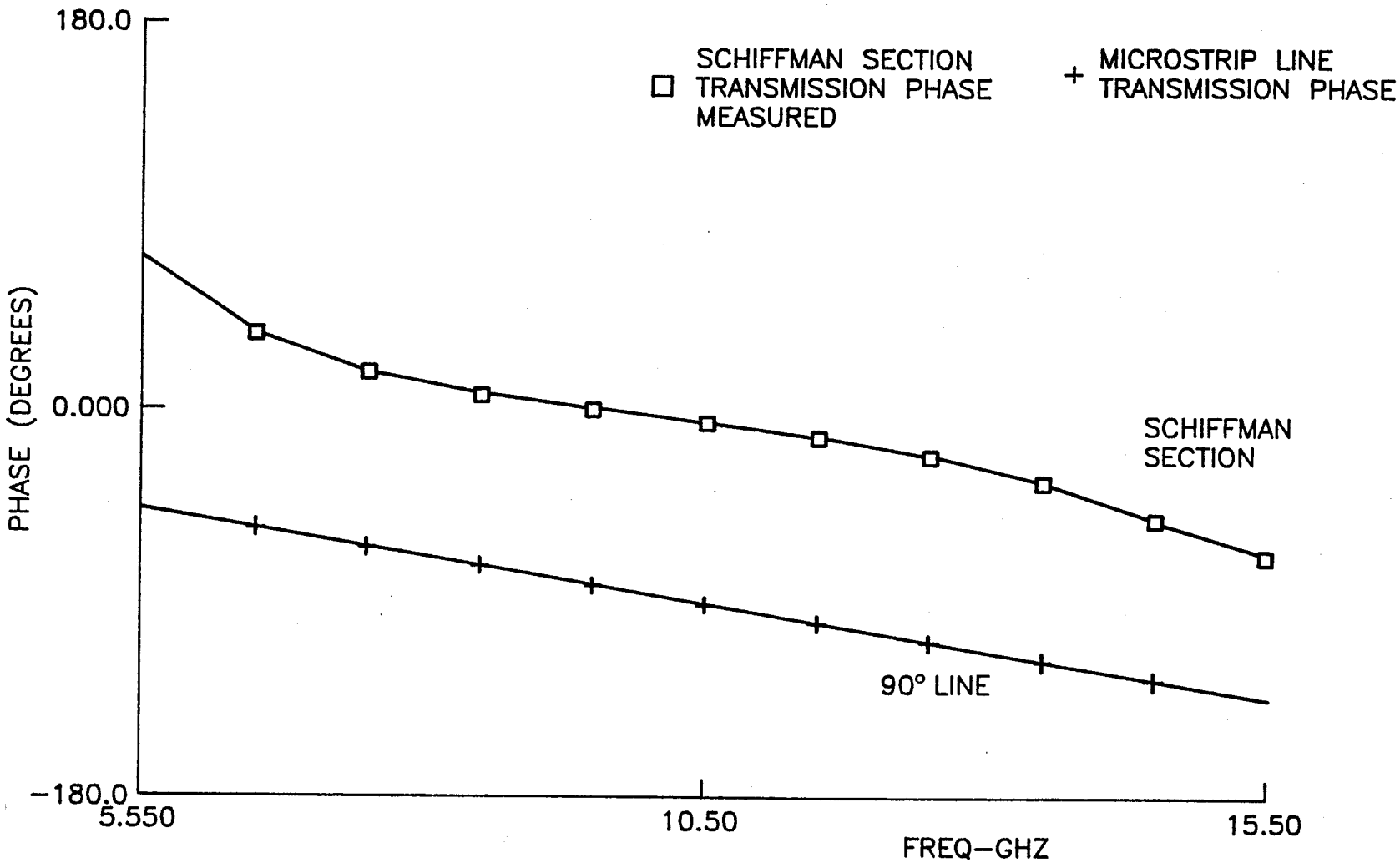
FIG. 8 is a graph depicting the offset broadside coupled Schiffman sections phase response compared to the response of a 90 degree transmission line.
Figure 9:
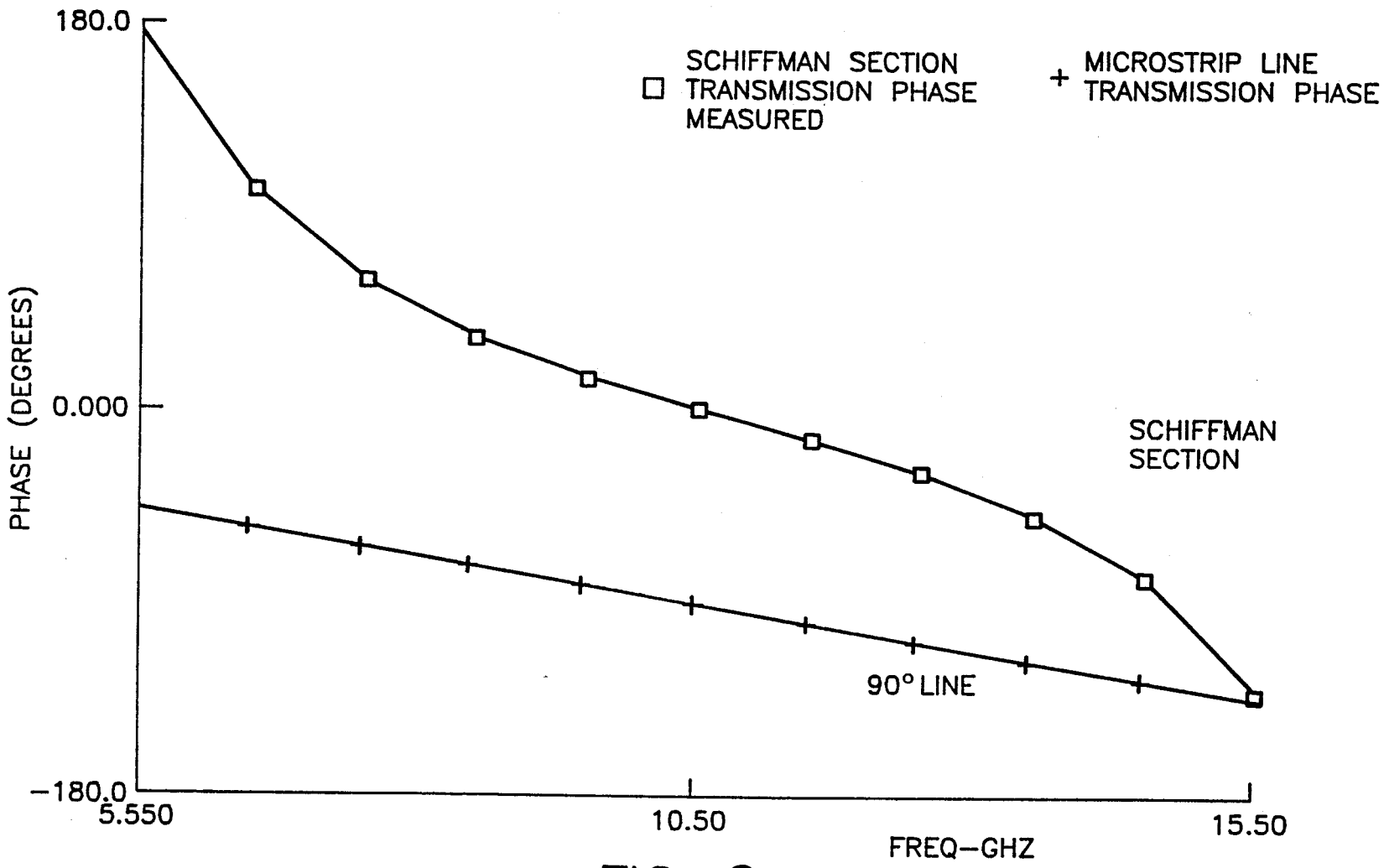
FIG. 9 is a graph depicting a phase response of a coupler fabricated according to this invention and as compared to the phase of a 90 degree transmission line.

FIG. 8 shows the phase response of this circuit compared to the phase response of a 90 degree length of 50 ohm microstrip line. The phase difference between these two responses is 90±10 degrees over the 6 to 15 GHz frequency range. As a comparison, FIG. 9 shows the phase response of a Schiffman section constructed using a 4-conductor interdigitated structure (similar to a Lange coupler) which used 8 μm wide lines with 8 μm spacings. The bandwidth of this circuit is only 4 GHz compared to the 9 GHz achieved by using the tightly coupled structure. As one can ascertain, the above described apparatus and technique can be used with all quadrature couplers and other coupler devices and can be implemented on substrates of varying thickness. The major advantages of the above described coupler, as compared to other types of couplers such as stripline, broadside and microstrip Lange couplers are that there is relatively no restriction on the GaAs substrate thickness. There is also relatively no restriction on achieving different coupling coefficients. The device is quasi planar and requires no air bridges and is completely compatible with monolithic technology as there are no additional steps required to fabricate the coupler. The coupler can also be employed with a crossover. In many MIC and MMIC circuits, such as balanced amplifiers, the outputs are required to be on the same side. This crossover can be constructed with or without air bridge capability in the process.

Thus, a plated microstrip line can cross from one side of a coupler to the other side connecting to the plating which is attached to an embedded microstrip using air bridge technology. In a similar manner, the embedded microstrip conductor can cross under the plating and attach to the microstrip on the other side through a via hole in the dielectric. Essentially, the above described technique produces coupled line structures that can be used to realize extremely tight coupling factors and the techniques employed are completely compatible with MMIC fabrication. The couplers according to these techniques can operate in the range of 5 to 21 GHz. A broadband single section quadrature coupler and a 6–15 GHz broadband 90 degree bandwidth Schiffman section coupler have been fabricated having excellent performance. Such bandwidths are extremely difficult and have not been realized on thin gallium-arsenide substrates. The coupled structures can be utilized to realize a wide variety of broadband circuits on MMICs, as for example, mixers, phase shifters, balanced amplifiers, and so on.

It will be appreciated that modifications and variations of the present invention are covered by the above teachings and within the purview of the appended claims without departing from the spirit and scope of the present invention.

What is claimed is:

1. A microwave coupled line apparatus for providing tight coupling at microwave frequencies, comprising:

a substrate formed of a semiconductor material and having a top surface, a bottom surface, a first end, and a second end;

a first embedded metal line located on said top surface of said substrate and extending from said first end of said substrate to said second end of said substrate;

a dielectric layer covering said first metal line and said top surface of said substrate;

a second metal line positioned on said dielectric layer also extending from said first end of said substrate to said second end of said substrate and positioned such that; a first portion of said first metal line is overlapped by a first portion of said second metal line, a second portion of said first metal line and a second portion of said second metal line not overlapping; and a ground plane on said bottom surface of said substrate.

2. The coupled line structure according to claim 1, wherein said first and second lines overlie one another by 2 μm, with each line being 10 μm wide to provide a coupling factor of at least 0.7 dB.

3. The coupled line structure according to claim 1, wherein said first and second lines are 10 μm wide.

4. A microwave coupled line apparatus as recited in claim 1 wherein said said first metal line and said second metal line are substantially parallel.

5. A microwave coupled line apparatus as recited in claim 1 wherein said first portion of said first metal line is parallel to said first portion of said second metal line.

6. The coupled line apparatus according to claim 1, wherein said semiconductor material is GaAs.

7. The coupled line apparatus according to claim 6, wherein said dielectric layer is silicon nitride.

8. The coupled line apparatus according to claim 6, wherein said substrate is 125 μm thick, with said first embedded metal line being about 0.6 μm thick, with said dielectric layer being about 0.2 μm thick and with said second line being about 4.5 μm thick and about 10 μm wide, to enable microwave signals in the range between 6 to 15 GHz to couple between said lines at a bandwidth in excess of about 9 GHz.

9. The coupled line apparatus according to claim 1, further including a third metallic line located on said dielectric layer on said top surface of said substrate and parallel to said second metal line and spaced therefrom to enable coupling between said first, second and third lines.

10. The coupled line apparatus according to claim 9 wherein said third and second lines are plated metal lines with said first embedded line being an unplated metal line.

11. The coupled line apparatus according to claim 9 wherein said third line is separated from said second line by a distance so that the edge of said second line is parallel and spaced from the edge of said third line.

12. The coupled line structure according to claim 11, wherein said third line being about 4.5 μm thick with a width of 30 μm to enable microwave signals in the range of 5 to 21 GHz to couple between said lines at a bandwidth of about 16 GHz.

13. The coupled line apparatus according to claim 11, wherein said spacing between said second and third lines is 10 μm.

* * * * *